United States Patent [19]

Marco

[11] Patent Number: 5,020,661

[45] Date of Patent: Jun. 4, 1991

[54] CARRIER STOCK WITH TEAR-OPEN TABS

[75] Inventor: Leslie S. Marco, Bloomingdale, Ill.

[73] Assignee: Illinois Tool Works Inc., Glenview, Ill.

[21] Appl. No.: 537,674

[22] Filed: Jun. 14, 1990

[51] Int. Cl.[5] ..... B65D 71/00

[52] U.S. Cl. ..... 206/150; 206/620

[58] Field of Search ..... 206/150, 151, 158, 160, 206/620, 628; 294/87.2

[56] References Cited

U.S. PATENT DOCUMENTS

| | | | |
|---|---|---|---|
| 2,997,169 | 8/1961 | Poupitch . | |
| 3,038,602 | 6/1962 | Rapata . | |
| 3,084,792 | 4/1963 | Poupitch | 206/150 |
| 3,086,651 | 4/1963 | Poupitch . | |
| 3,504,790 | 4/1970 | Owen . | |
| 3,721,337 | 3/1973 | Braun et al. . | |
| 4,064,989 | 12/1977 | Olsen | 206/428 |
| 4,109,787 | 8/1978 | Klygis et al. | 206/150 |
| 4,925,020 | 5/1990 | Gordon | 206/150 |

*Primary Examiner*—Jimmy G. Foster

*Attorney, Agent, or Firm*—Thomas W. Buckman; John P. O'Brien; Donald J. Breh

[57] ABSTRACT

Carrier stock formed from a single sheet of resilient polymeric material, such as low density polyethylene, for machine application to substantially identical containers. The stock is severable to form individual carriers with container-receiving apertures, as defined by band segments, which include outer segments formed with tear-open tabs. Each tab and the outer segment formed with such tab have multiple slits, which are arranged to define tearable bridges that can be easily torn by a user pulling on such tab, whereby the outer segment formed with such tab can be easily severed to release a container from the aperture bounded partly by such segment.

17 Claims, 2 Drawing Sheets

CARRIER STOCK WITH TEAR-OPEN TABS

TECHNICAL FIELD OF THE INVENTION

This invention pertains to carrier stock for machine application to substantially identical containers. This invention pertains, more particularly, to carrier stock that is severable to form individual carriers with separate apertures to receive the individual containers. Tear-open tabs are provided, which enable the containers to be easily removed.

BACKGROUND OF THE INVENTION

Typically, carrier stock with individual container-receiving apertures for machine application to substantially identical containers is formed, as by diecutting, from a single sheet of resilient polymeric material, such as low density polyethylene. An example of such carrier stock is disclosed in Weaver et al. U.S. Pat. No. 4,219,117.

Various attempts have been made to provide such carrier stock with tear-open capability. An example of particular interest is disclosed in Olsen U.S. Pat. No. 4,064,989.

As disclosed in Olsen U.S. Pat. No. 4,064,989, outer band segments of such carrier stock are formed with tear-open tabs, which extend from outer band segments. A slit, which is associated with each tab, extends at an acute angle to a line drawn to a base of such tab. An arrow is impressed on each tab so as to indicate, to a user, in which direction to pull such tab so as to sever the outer segment formed with such tab. In actual experience with such stock, it has been found that if the user pulls in a wrong direction there is some risk of failure due to a tab being torn away without the outer segment being torn through, or due to the outer segment exhibiting excessive resistance to being torn through.

A recent example of an attempt to provide carrier stock with tear-open capability is disclosed in Gordon U.S. Pat. No. 4,925,020. Older examples are disclosed in Poupitch U.S. Pat. No. 2,997,169, Rapata U.S. Pat. No. 3,038,602, Poupitch U.S. Pat. No. 3,086,651, Owen U.S. Pat. No. 3,504,790, and Braun et al. U.S. Pat. No. 3,721,337.

There has remained a need, to which this invention is addressed, for improved carrier stock with tear-open capability.

. SUMMARY OF THE INVENTION

This invention provides carrier stock formed from a single sheet of resilient polymeric material, such as low density polyethylene, for machine application to substantially identical containers. Such stock is severable to form individual carriers, which are configured to include tear-open tabs enabling the containers to be easily removed. Each individual carrier has separate apertures to receive the individual containers. Preferably, the separate apertures are arranged in two longitudinal rows.

The stock is formed for each individual carrier with integrally joined band segments defining the separate apertures. The band segments include outer segments extending generally in a longitudinal direction when the stock is unstressed.

Each outer segment is formed with a tear-open tab extending in a generally transverse direction when the stock is unstressed. It is preferred that each tab extends into one of the separate apertures when the stock is unstressed. Moreover, it is a characteristic feature of this invention that each tab is slitted so as to define a series of frangible bridges, as described below.

A first slit of each tab extends in a generally longitudinal direction when the stock is unstressed. Preferably, the first slit of each tab has an open end at the outer edge of such tab and a closed end. Alternatively, the first slit of each tab has one end adjacent to but spaced from the outer edge of such tab so as to define a frangible bridge between such end of the first slit and the outer edge of such tab.

A second slit of each tab extends in a generally transverse direction when the carrier stock is unstressed. Preferably, the second slit is spaced from the first slit so that a frangible bridge is defined between the first and second slits. Alternatively, the first and second slits may be sections of a continuous slit, which may comprise a curved slit connecting the first and second slits.

It is a preferred feature that the first and second slits of each tab are arranged so that an imaginary line extending in a generally longitudinally direction from the first slit of such tab intersects the second slit of such tab. Thus, a portion of the second slit extends on each side of the imaginary line, when said stock is unstressed.

In a preferred arrangement, each outer segment is slitted so as to define third and fourth slits, as described below. In considering the third and fourth slits, it is convenient to refer to each outer segment as having first and second edges with the first edge merging with the outer edge of the tab extending from such outer segment.

Each of the third and fourth slits extends in a generally longitudinal direction when the stock is unstressed. The third and fourth slits of each outer segment are arranged so that a frangible bridge is defined between such third slit and the second slit of the tab extending from such outer segment, so that a frangible bridge is defined between such third and fourth slits, and so that a frangible bridge is defined between such fourth slit and the second edge of such outer segment.

The slits associated with each tab are arranged so that the outer segments are not weakened significantly but so that the frangible bridges can be easily torn by a user pulling on such tab, whereby the outer segment formed with such tab can be easily severed to release a container from the aperture bounded partly by such outer segment. There is minimum risk of failure due to such outer segment breaking in application machinery, or due to such tab being torn away without tearing through such outer segment. At least in the preferred arrangement, there is minimal risk of failure due to such outer segment exhibiting excessive resistance to being torn through.

Herein, references to slits in the carrier stock are intended to refer to scorings, or lines that are not cut entirely through the carrier stock, as well as to those that are cut entirely through the carrier stock and to slits defined by plural perforations.

These and other objects, features, and advantages of this invention are evident from the following description of certain embodiments of this invention, with reference to the accompanying drawings.

DETAILED DESCRIPTION OF THE ILLUSTRATED EMBODIMENTS

Figure 1:
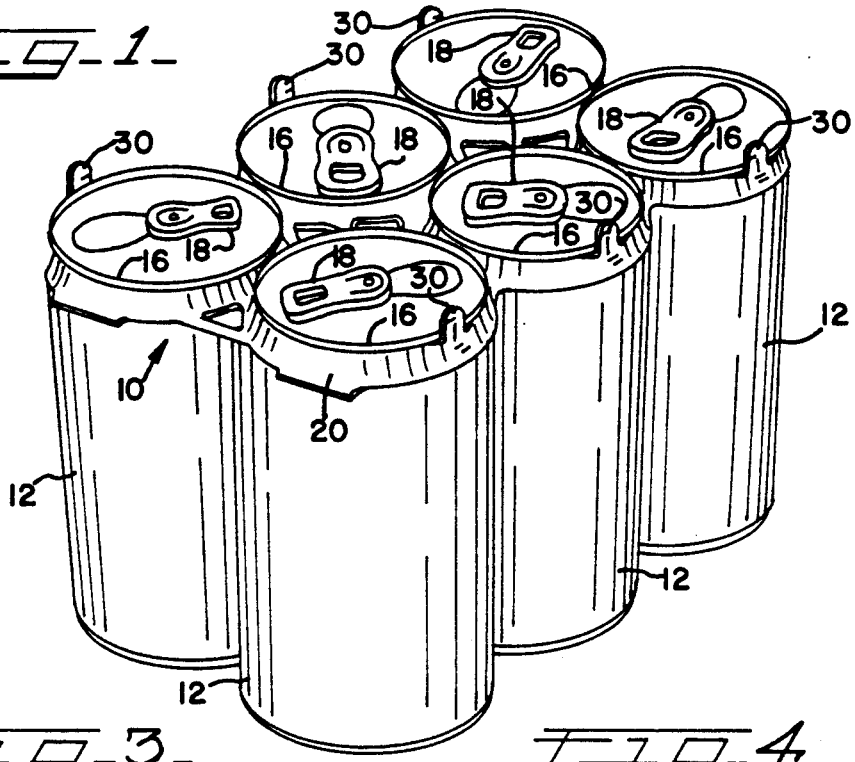
FIG. 1 is a perspective view of a package comprising six identical containers and a carrier, which is severed from carrier stock according to this invention.
Figure 2:
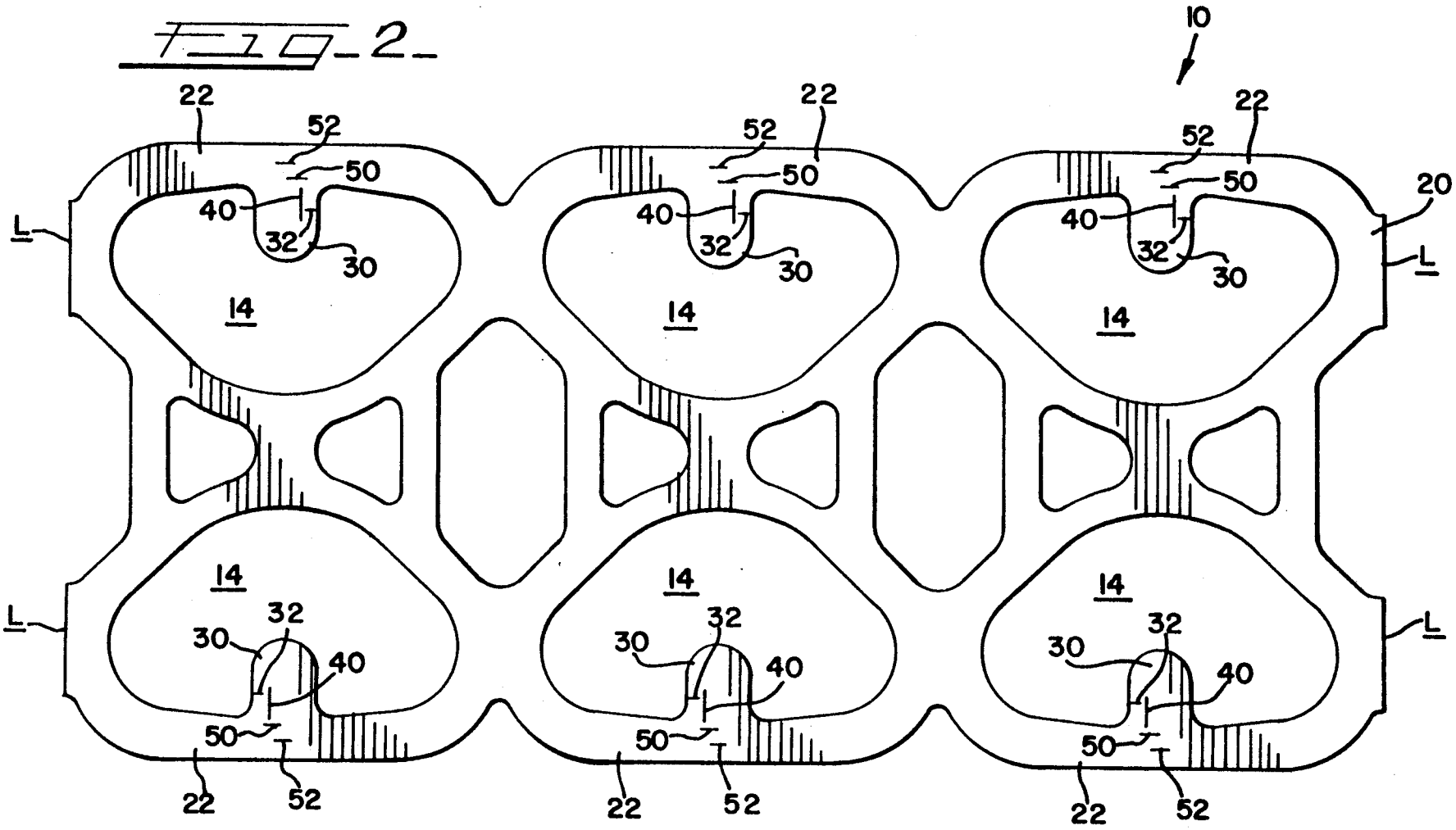
FIG. 2 is a plan view of a carrier severed from carrier stock according to a preferred embodiment of this invention.

As shown in FIGS. 1 and 2, carrier stock 10 for machine application to substantially identical containers 12 constitutes a preferred embodiment of this invention. Such stock 10 is formed with separate apertures 14 to receive the individual containers 12. The carrier stock 10 is severable along transverse lines L, to form individual carriers 20 (one shown) that are substantially identical.

As shown in FIG. 1, the containers 12 are beverage cans of a type used commonly for beer, soft drinks, and other beverages. Also, each container 12 has a chime 16 at one end, which is provided with a pull tab 18. This invention is not limited, however, to usage with such cans but is useful with cans, bottles, and other containers of various types.

In FIG. 1, a package is shown, which comprises six such containers 12 and one such carrier 20, as severed from such stock 10. While the carrier 20 is shown to be directly adjacent the chimes 16, this invention is not limited to this location on the containers 12. This invention contemplates that the carrier 20 may be positioned downwardly on the side walls of such containers. In FIG. 2, one such carrier 20 is shown in an unstressed condition.

The carrier stock 10 is formed in an indeterminate length, as by die-cutting, from a single sheet of resilient polymeric material. A preferred material is low density polyethylene. A preferred thickness for such stock 10 in an unstressed condition, if low density polyethylene is used, is about 16 mils.

The carrier stock 10 is formed, for each individual carrier 20, with integrally joined band segments defining six separate apertures 14. As shown in FIG. 2, such apertures are in a rectangular array with longitudinal rows and transverse ranks, namely two longitudinal rows and three transverse ranks. The band segments include outer segments 22 extending in a generally longitudinal direction when such stock 10 is unstressed.

It is a characteristic feature of the preferred embodiment shown in FIGS. 1, 2, and 3 that each tab 30 is slitted so as to define first and second slits described below.

Each outer segment 22 is formed with a tear-open tab 30 extending in a generally transverse direction when the carrier stock 10 is unstressed. Such tab 30 extends from a midportion of such outer segment 22. Preferably, as shown, each tab 30 extends inwardly, into one of the separate apertures 14, when such stock 10 is unstressed. Alternatively, however, each tab 30 may extend outwardly when such stock 10 is unstressed.

The first slit 32 of each tab 30 extends in a generally longitudinal direction when the carrier stock is unstressed. Such slit 32 has an open end 34 at an outer edge 36 of such tab 30, as shown, and a closed end 38.

The second slit 40 of each tab 30 extends in a generally transverse direction when the carrier stock 10 is unstressed. The second slit 40 is spaced from the first slit 32 so as to define a frangible bridge 42 between the first and second slits.

The first and second slits of each tab 30 are arranged so that an imaginary line extending in a generally longitudinal direction from the first slit 32 intersects the second slit 40. Thus, as shown, a portion of the second slit 40 extends on each side of the imaginary line when the carrier stock 10 is unstressed. Consequently, as the frangible bridge 42 is torn by a user pulling on such tab 30, there is minimal risk that part of such tab 30 will be torn away from the remainder of such tab 30 or that such tab 30 will be torn away from the outer segment 22 formed with such tab 30. Continued pulling force will be directed substantially transversely of the outer segment 22 as a result of the orientation of the second slit 40.

Since the band segments including the outer segments 22 are tensioned by application machinery (not shown) when the carrier stock 10 is applied to the containers 12, it is important that the second slit 40 of each tab 30 does not weaken the outer segment 22 formed with such tab 30. Thus, the second slit 40 of each tab 30 extends approximately to but not substantially beyond an imaginary line where such tab 30 merges with the outer segment 22 formed with such tab 30, and along which such tab 30 tends to fold, as shown in FIG. 1, when the carrier stock 10 is applied to the containers 12.

It is a characteristic feature of the preferred embodiment shown in FIGS. 1, 2, and 3 that, in a region near each tab 30, each outer segment 22 is slitted to define third and fourth slits described below.

In considering the third and fourth slits, it is convenient to refer to each outer segment 22 as having a first or inner edge 44 divided into separate portions, one on each side of the tab 30 extending from such segment 22, and as having a second or outer edge 46. The first or inner edge 44 merges with the outer edge 36 of such tab 30 and tends to coincide with an imaginary line along which such tab 30 tends to fold, as shown in FIG. 1, upon machine application of the carrier stock 10 to the aforementioned containers.

Each of the third and fourth slits of each outer segment 22 extends in a generally longitudinal direction when the carrier stock 10 is unstressed. Consequently, such segment 22 is not weakened substantially by its third and fourth slits and does not tend to break when tensioned by application machinery (not shown) used for machine application of the carrier stock 10 to the aforementioned containers 12.

In each outer segment 22, the third slit 50 is closer to the first or inner edge 44 of such segment 22, and the fourth slit 52 is closer to its second or outer edge 46. Moreover, the third and fourth slits are arranged so that an imaginary line extending in a generally transverse direction from the second slit 40 of the tab 30 extending from such segment 22 when the carrier stock 22 is unstressed intersects the third slit 50, approximately at a right angle, as shown, but does not intersect the fourth slit 52. As shown, the first slit 32 of such tab 30 and the fourth slit 52 of such segment 22 are on opposite sides of the imaginary line mentioned in the preceding sentence.

The third and fourth slits of each outer segment 22 are arranged so as to define a frangible bridge 54 between the third slit 50 of such outer segment 22 and the second slit 40 of the tab 30 extending from such outer segment 22, a frangible bridge 56 between such third and fourth slits, and a frangible bridge 58 between the fourth slit 52 of such outer segment 22 and the second or outer edge 46 of such outer segment 22. The frangible bridges defined by the first, second, third and fourth slits are arranged in a longitudinally staggered series, as shown.

Figure 3:
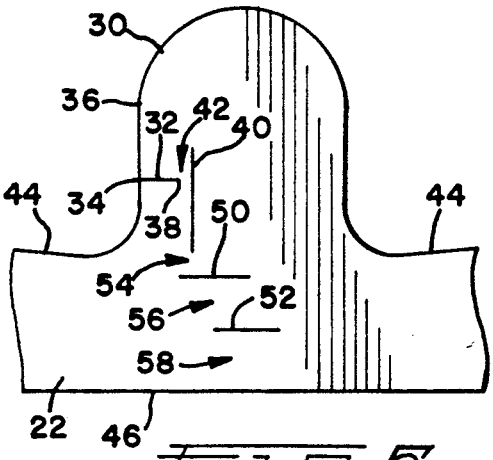
FIG. 3 is an enlarged, fragmentary detail showing a representative one of a plurality of tear-open tabs characteristic of the carrier stock, as shown in FIG. 2.
Figure 4:
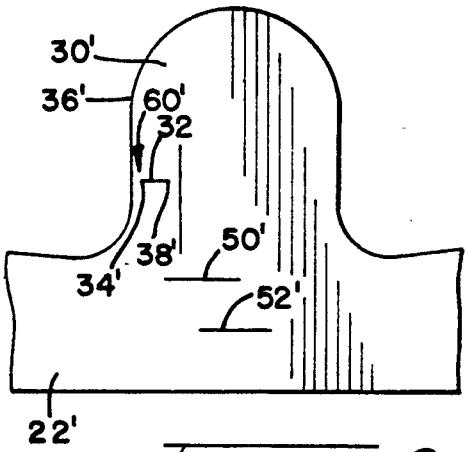
FIG. 4 is an analogous, fragmentary detail showing a tear-open tab characteristic of carrier stock according to an alternate embodiment of this invention.
Figure 5:
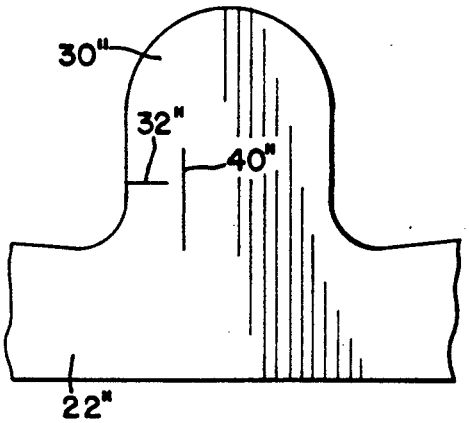
FIG. 5 is an analogous, fragmentary detail showing a tear-open tab characteristic of carrier stock according to a simplified embodiment of this invention.
Figure 6:
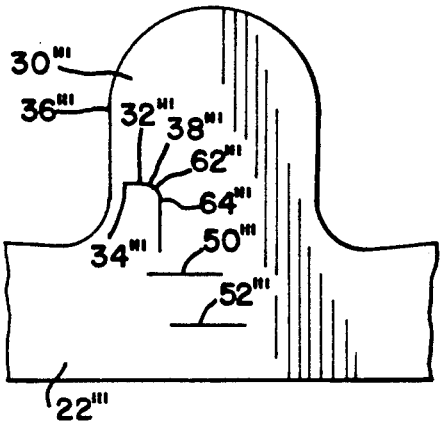
FIG. 6 is an analogous, fragmentary detail showing a tear-open tab characteristic of carrier stock according to a further embodiment of this invention.

Elements similar to elements designated by unprimed reference numbers in FIGS. 1, 2, and 3 are designated by primed reference numbers in FIG. 4, by double-primed reference numbers in FIG. 5, and by triple-primed reference numbers in FIG. 6.

The alternate embodiment shown in FIG. 4 is similar to the preferred embodiment shown in FIGS. 1, 2, and 3 except that the first slit 32' of each tab 30' extending from each outer segment 22' is closed at each of its ends 34', 38', and is spaced from the outer edge 36' of such tab 30' so as to define a frangible bridge 60' between the end 34' closer to such edge 36' and the first slit 32'. The second slit 40' of each tab 30' is similar to the second slit 40 of each tab 30. The third slit 50' of each outer segment 22' is similar to the third slit 50 of each outer segment 22. The fourth slit 52' of each outer segment 22' is similar to the fourth slit 52 of each outer segment 22.

The simplified embodiment shown in FIG. 5 is similar to the preferred embodiment shown in FIGS. 1, 2, and 3 except that the third and fourth slits are omitted. The first slit 32'' of each tab 30'' extending from each outer segment 22'' is similar to the first slit 32 of each tab 30. The second slit 40'' of each tab 30 is similar to the second slit 40 of each tab 30. As a possible modification (not shown) the first and second slits may be similar to the first and second slits of the alternate embodiment shown in FIG. 4 and described above.

A simplified embodiment (not shown) is contemplated that is similar to the preferred embodiment shown in FIGS. 1, 2, and 3 except that the fourth slits are omitted. The first, second, and third slits are similar to the first, second, and third slits of the preferred embodiment shown in FIGS. 1, 2, and 3 or to the first, second, and third slits of the alternate embodiment shown in FIG. 4. As a possible modification (not shown) the third slits may be centered between the inner and outer edges of the outer segments.

The further embodiment shown in FIG. 6 is similar to the alternate embodiment shown in FIG. 4 except that the first and second slits of each tab 30''' are sections of a continuous slit. As shown in FIG. 6, the first and second slits of each tab 30''' are connected by a curved, substantially arcuate section 62''' of the continuous slit. The curved section 62''' extends between one end 38''' of the first slit 32''' and one end 64''' of the second slit 40'''. A frangible bridge 60''' is defined between the other end 34''' of the first slit 32''' and the outer edge 36''' of such tab 30'''. The second slit 40''' extends approximately to but not substantially beyond an imaginary line where such tab 30''' merges with the outer segment 22''' formed with such tab 30'''. The third slit 50''' of each outer segment 22''' is similar to the third slit 50 of each outer segment 22. The fourth slit 52''' of each outer segment 22''' is similar to the fourth slit 52 of each outer segment 22.

In the further embodiment shown in FIG. 4, tear-away force exerted by a user on each tab 30''' will be first directed parallel to the longitudinal direction of the carrier stock and, then, continuously directed perpendicularly, in a transverse direction relative to such stock, so as to insure that rupture occurs across the outer segment 22''' formed with such tab 30''' rather than across such tab 30'''.

In each of the illustrated and contemplated embodiments, the slits are arranged so that the outer segments are not weakened substantially, but so that the frangible bridges can be easily torn by a user pulling on the tear-open tabs. The outer segments can be easily severed so as to release the containers from the apertures bounded partly by the outer segments.

In each of the illustrated and contemplated embodiments, there is minimal risk of failure due to any outer segment breaking in application machinery used to apply the carrier stock to the containers. Moreover, there is minimal risk of failure due to any tear-open tab being torn away without the associated outer segment being torn through.

In the preferred embodiment, and in the contemplated embodiments including third slits but not fourth slits, there is minimal risk of failure due to any outer segment exhibiting excessive resistance to being torn through.

Various other modifications may be made without departing from the scope and spirit of this invention.

I claim:

1. Carrier stock for machine application to substantially identical containers, said stock being formed from a single sheet of resilient polymeric material and being severable to form individual carriers with separate apertures to receive the individual containers, said stock being formed for each individual carrier with integrally joined band segments defining the separate apertures, said segments including outer segments extending in a generally longitudinal direction when said stock is unstressed, each outer segment being formed with a tab extending in a generally transverse direction from such outer segment when said stock is unstressed, each tab being slitted therein so as to define a first slit, which extends in a generally longitudinal direction when said stock is unstressed, and each tab being slitted so as to define a second slit, which extends in a generally transverse direction when said stock is unstressed.

2. The carrier stock of claim 1 wherein each tab is arranged to extend into one of the separate apertures when said stock is unstressed.

3. The carrier stock of claim 1 wherein the band segments define two longitudinal rows of the separate apertures.

4. The carrier stock of claim 1 wherein each tab has an outer edge and wherein the first slit of each tab has an open end at the outer edge of such tab and a closed end.

5. The carrier stock of claim 1 wherein each tab has an outer edge and wherein the first slit of each tab has one end spaced from the outer edge of such tab so as to define a frangible bridge between said end and the outer edge of such tab.

6. The carrier stock of claim 1 wherein the first and second slits of each tab are arranged so that an imaginary line extending in a generally longitudinal direction from the first slit of such tab intersects the second slit of such tab so that a portion of the second slit of such tab extends on each side of the imaginary line when said stock is unstressed.

7. The carrier stock of claim 1 wherein each outer segment is slitted so as to define a third slit, which extends in a generally longitudinal direction when said stock is unstressed, so that a frangible bridge is defined between the third slit, and the second slit of the tab extending from such outer segment.

8. The carrier stock of claim 1 wherein each outer segment has a first edge and a second edge, the first edge merging with the outer edge of the tab extending from such outer segments, and wherein each outer segment is slitted so as to define a third slit, which extends in a generally longitudinal direction when said stock is unstressed so that a frangible bridge is defined between the third slit and the second slit of the tab extending from such outer segment, so as to define a fourth slit, which extends in a generally longitudinal direction when said stock is unstressed, so that a frangible bridge is defined between the third and fourth slits and so that a frangible bridge is defined between the fourth slit and the second edge of such outer segment.

9. The carrier stock of claim 1 wherein, at each tab, the second slit is spaced from the first slit so as to define a frangible bridge between the first and second slits.

10. The carrier stock of claim 1 wherein each tab has an outer edge and wherein the first and second slits of each tab are sections of a continuous slit comprising one end spaced from the outer edge of such tab so as to define a frangible bridge between said end and the outer edge of such tab.

11. The carrier stock of claim 10 wherein the continuous slit of each tab comprises a curved section connecting the first and second slits of such tab.

12. Carrier stock for machine application to substantially identical containers, said stock being formed from a single sheet of resilient polymeric material and being severable to form individual carriers with separate apertures to receive the individual containers, said stock being formed for each individual carrier with integrally joined band segments defining the separate apertures, said segments including outer segments extending in a generally longitudinal direction when said stock is unstressed, each outer segment being formed with a tab extending in a generally transverse direction from such outer segment when said stock is unstressed, each tab extending into one of the separate apertures when said stock is unstressed, each tab having an outer edge, each outer segment having an outer edge and an inner edge with the inner edge merging with the outer edge of the tab extending from such outer segment, each tab and each outer segment being slitted therein so as to define a series of frangible bridges between the outer edge of such tab and the outer edge of such outer segment.

13. The carrier stock of claim 12 wherein each outer segment is slitted so as to define a first slit, which extends in a generally longitudinal direction when said stock is unstressed and which has an open end at the outer edge of such tab and a closed end, each tab being slitted so as to define a second slit, which extends in a generally transverse direction when said stock is unstressed and which is intersected by an imaginary line extending in a generally longitudinal direction from the first slit of such tab so that a portion of the second slit extends on each side of the imaginary line when said stock is unstressed.

14. The carrier stock of claim 13 wherein each segment is slitted so as to define a third slit, which extends in a generally longitudinal direction when said stock is unstressed so that a tearable bridge is defined between the third slit and the second slit of the tab extending from such outer segment, so as to define a fourth slit, which extends in a generally longitudinal direction when said stock is unstressed so that a tearable bridge is defined between the third and fourth slits and so that a tearable bridge is defined between the fourth slit and the outer edge of such outer segment.

15. The carrier stock of claim 12 wherein the series of frangible bridges include longitudinally staggered bridges.

16. The carrier stock of claim 12 wherein the series of frangible bridges are defined by slits including a slit in each tab and a slit in the outer segment formed with such tab.

17. The carrier stock of claim 16 wherein the last-mentioned slits are disposed approximately at a right angle to each other when the carrier stock is unstressed.

* * * * *